US011772156B2

(12) United States Patent
Wang et al.

(10) Patent No.: US 11,772,156 B2
(45) Date of Patent: Oct. 3, 2023

(54) IN-LINE PRESSURIZATION CHAMBER FOR CASTING

(71) Applicant: GM GLOBAL TECHNOLOGY OPERATIONS LLC, Detroit, MI (US)

(72) Inventors: Qigui Wang, Rochester Hills, MI (US); Thomas W. Gustafson, Clarkston, MI (US); Steven L Burkholder, Archbold, OH (US); Daniel J. Wilson, Linden, MI (US); Gregory Melekian, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 311 days.

(21) Appl. No.: 17/153,049

(22) Filed: Jan. 20, 2021

(65) Prior Publication Data

US 2022/0226885 A1 Jul. 21, 2022

(51) Int. Cl.
*B22D 27/13* (2006.01)
*B22D 47/02* (2006.01)

(52) U.S. Cl.
CPC ..... *B22D 47/02* (2013.01); *B22D 27/13* (2013.01)

(58) Field of Classification Search
CPC ..... B22D 47/00; B22D 47/02; B22D 27/13
See application file for complete search history.

(56) References Cited

U.S. PATENT DOCUMENTS

| | | | | |
|---|---|---|---|---|
| 3,420,291 A * | 1/1969 | Chandley | ..... | B22D 27/13 164/66.1 |
| 5,335,711 A * | 8/1994 | Paine | ..... | B22D 27/13 164/136 |
| 2019/0118254 A1* | 4/2019 | Suehara | ..... | B22D 27/13 |

FOREIGN PATENT DOCUMENTS

| | | |
|---|---|---|
| CN | 106914606 A | 7/2017 |
| EP | 0677347 A1 | 10/1995 |

* cited by examiner

*Primary Examiner* — Kevin E Yoon
(74) *Attorney, Agent, or Firm* — Lorenz & Kopf LLP

(57) ABSTRACT

Methods and systems are provided for continuously producing cast metal components. An exemplary method includes feeding molten metal into a first mold at a fill station; maintaining a pressurized chamber at an elevated pressure; moving the first mold into the pressurized chamber, wherein the molten metal solidifies in the first mold under the elevated pressure; and removing the first mold from the pressurized chamber.

20 Claims, 3 Drawing Sheets

IN-LINE PRESSURIZATION CHAMBER FOR CASTING

INTRODUCTION

The technical field generally relates to methods and systems for casting structural components, non-limiting examples of which include engine blocks, cylinder heads, suspension parts such as shock towers and control arms, wheels, and airplane doors. In particular, methods and systems are provided for casting aluminum with reduced porosity for such structural components.

Aluminum castings are widely used in structural applications because of their high strength to weight ratio, good corrosion resistance, and relatively low raw material cost. While cost competitive with other manufacturing methods, the casting process associated with aluminum alloys can introduce a significant amount of defects.

For example, during the casting process, as the molten aluminum cools it may shrink, leading to the formation of porosity within portions of the component. Porosity in castings significantly decreases material mechanical properties, particularly fatigue performance. For certain uses, the porous casting may be saved by filling the pores, typically through use of an expensive process. In other used, the casting must be wasted.

There are many approaches that have be used in practice to reduce casting defects in aluminum castings, such as quiescent mold filling with low pressure or electric magnetic pump, fast solidification with heavy metal chills, metal mold, or ablation process, and pressurization during solidification for instance in high-pressure die casting (HPDC) and lost foam casting. However, no effective pressurization technique has been used in sand casting, semi-permanent mold casting, and permanent mold casting processes.

Accordingly, it is desirable to provide methods and systems, suitable for both sand and metal mold casting processes, for continuously producing improved aluminum castings with reduced casting porosity and improved alloy strength, fatigue, and corrosion resistance. In addition, it is desirable to provide such methods and systems that employ a continuous casting process. Furthermore, other desirable features and characteristics of embodiments herein will become apparent from the subsequent detailed description and the appended claims, taken in conjunction with the accompanying drawings and the foregoing technical field and background.

SUMMARY

A method is provided for continuously producing cast metal components. In one embodiment, the method includes feeding molten metal into a first mold at a fill station; maintaining a pressurized chamber at an elevated pressure; moving the first mold into the pressurized chamber, wherein the molten metal solidifies in the first mold under the elevated pressure; and removing the first mold from the pressurized chamber.

In exemplary embodiments, the method is performed in a casting line, and the pressurized chamber moves in the casting line.

In exemplary embodiments, the pressurized chamber is stationary.

In exemplary embodiments, the method is performed in a carousel casting line.

In exemplary embodiments, the elevated pressure is at least 2 atmospheres (atm).

In exemplary embodiments, the method further includes filling the pressurized chamber with a high-conductivity inert gas.

In exemplary embodiments, the pressurized chamber includes different sections, and the method includes maintaining different gas mediums in the different sections.

In exemplary embodiments, the method further includes moving the first mold from the fill station to a pre-pressurization chamber section; sealing the pre-pressurization chamber section; increasing pressure in the pre-pressurization chamber section; opening fluid communication between a pressurized chamber section and the pre-pressurization chamber section; and transferring the first mold from the pre-pressurization chamber section to the pressurized chamber section. In exemplary embodiments, this method further includes maintaining a pressure-release chamber section at the elevated pressure; transferring the first mold from the pressurized chamber section to the pressure-release chamber section; sealing the pressurized chamber section; and removing the first mold from the pressure-release chamber section. Further, in the exemplary methods, the molten metal solidifies in the first mold under the elevated pressure in the pressure-release chamber section.

In exemplary embodiments, the method is performed in a casting line including, sequentially, a mold assembly station, a fill station, a pre-pressurization chamber section, a pressurized chamber section, a pressure-release chamber section, and a casting/mold disassembly station. In such embodiments, the method may further include assembling the first mold at the mold assembly station; moving the first mold to the fill station where the molten metal is fed into the first mold and assembling a second mold at the mold assembly station; moving the first mold to the pre-pressurization chamber section and moving the second mold to the fill station where the molten metal is fed into the second mold; sealing the pre-pressurization chamber section and increasing pressure in the pre-pressurization chamber section to the elevated pressure of the pressurized chamber section; opening fluid communication between the pressurized chamber section and the pre-pressurization chamber section and transferring the first mold from the pre-pressurization chamber section to the pressurized chamber section; sealing the pressurized chamber section; moving the second mold to the pre-pressurization chamber section; sealing the pre-pressurization chamber section and increasing pressure in the pre-pressurization chamber section to the elevated pressure of the pressurized chamber section; opening fluid communication between the pressurized chamber section and the pre-pressurization chamber section and transferring the second mold from the pre-pressurization chamber section to the pressurized chamber section; opening fluid communication between the pressurized chamber section and the pressure-release chamber section and transferring the first mold from the pre-pressurization chamber section to the pressure-release chamber section; transferring the first mold from the pressure-release chamber section to the casting/mold disassembly station; sealing the pressure-release chamber section and increasing pressure in the pressure-release chamber section to the elevated pressure of the pressurized chamber section; opening fluid communication between the pressurized chamber section and the pressure-release chamber section and transferring the second mold from the pre-pressurization chamber section to the pressure-release chamber section; disassembling the first mold and first casting formed therein at the casting/mold disassembly station; transferring the second mold from the pressure-release chamber section to the casting/mold disassembly station; and disassembling the second mold and second casting formed therein at the casting/mold disassembly station.

Further, an in-line casting system is provided. In one embodiment, the system includes a mold assembly station for assembling a mold; a fill station for filling the mold with molten metal; a pressurization station for densifying the molten and/or semi-solid metal under an elevated pressure; and a casting/mold disassembly station for disassembling the mold and a casting formed therein.

In exemplary embodiments, the pressurization station includes a pre-pressurization chamber section, a pressurized chamber section, and a pressure-release chamber section.

In exemplary embodiments, the pressurization station includes a pre-pressurization chamber section, a pressurized chamber section, and a pressure-release chamber section, wherein the pressurized chamber section is at a constant elevated pressure.

In exemplary embodiments, the system further includes a pressure gauge and valve to monitor pressure in the pressurization station and to selectively add a medium to the pressurization station.

In exemplary embodiments, the mold assembly station, fill station, pressurization station, and casting/mold disassembly station are arranged in a linear casting line.

In exemplary embodiments, the mold assembly station, fill station, pressurization station, and casting/mold disassembly station are arranged in a carrousel casting line.

In exemplary embodiments, the system further includes a control module and a sensor, wherein the sensor is arranged to monitor readiness of the pressurization station, and wherein the control module directs filling the mold at the fill station when the pressurization station is ready.

In one embodiment, an in-line casting system includes a mold assembly station for assembling a mold; a fill station for filling the mold with molten metal; a pressurization station for densifying the molten and/or semi-solid metal under an elevated pressure; a high thermal conductivity medium source for providing the pressurization station with a desired medium; and a casting/mold disassembly station for disassembling the mold and a casting formed therein.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
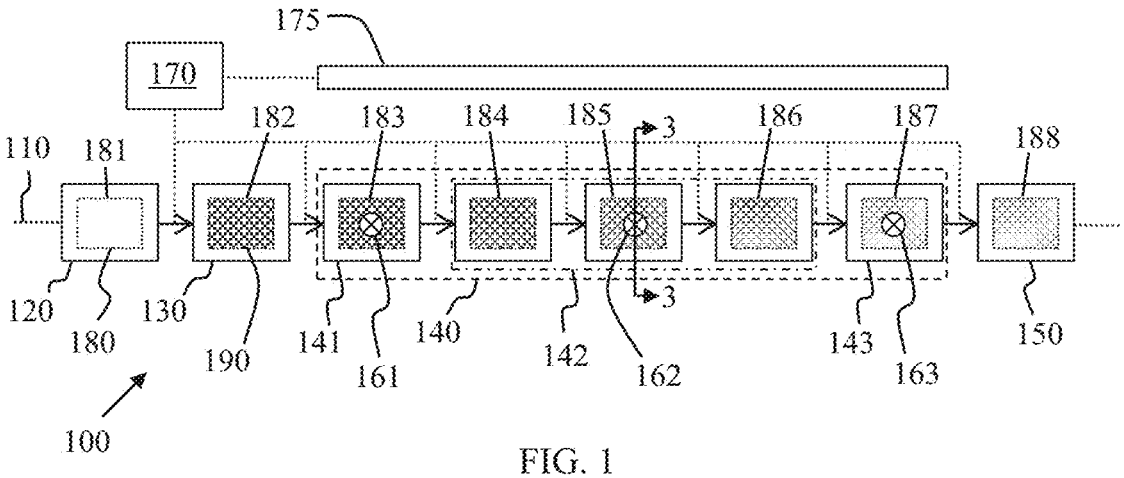
FIG. 1 is a schematic representation of an in-line casting system for reducing casting porosity in a continuous casting process in accordance with an embodiment herein.

The following detailed description is merely exemplary in nature and is not intended to limit the application and uses. Furthermore, there is no intention to be bound by any expressed or implied theory presented in the preceding technical field, background, brief summary or the following detailed description. As used herein, the term control module refers to an application specific integrated circuit (ASIC), an electronic circuit, a processor (shared, dedicated, or group) and memory that executes one or more software or firmware programs, a combinational logic circuit, and/or other suitable components that provide the described functionality.

As used herein, the word "exemplary" means "serving as an example, instance, or illustration". As used herein, "a," "an," or "the" means one or more unless otherwise specified. The term "or" can be conjunctive or disjunctive. Open terms such as "include," "including," "contain," "containing" and the like mean "comprising." In certain embodiments, numbers in this description indicating amounts, ratios of materials, physical properties of materials, and/or use are may be understood as being modified by the word "about". The term "about" as used in connection with a numerical value and the claims denotes an interval of accuracy, familiar and acceptable to a person skilled in the art. In general, such interval of accuracy is ±10%. All numbers in this description indicating amounts, ratios of materials, physical properties of materials, and/or use may be understood as modified by the word "about," except as otherwise explicitly indicated.

As used herein, the "%" or "percent" described in the present disclosure refers to the weight percentage unless otherwise indicated. Further, as used herein, an element identified as a "material" includes at least 50 wt. % of the recited material. As used herein, an element identified as "primarily material" is a material that includes at least 90 wt. % of the recited material.

Further, terms such as "upper", "lower", "above," "over," "below," "under," "upward," "downward," et cetera, are used descriptively of the figures, and do not represent limitations on the scope of the subject matter, as defined by the appended claims. Any numerical designations, such as "first" or "second" are illustrative only and are not intended to limit the scope of the subject matter in any way. It is noted that while embodiments may be described herein with respect to automotive applications, those skilled in the art will recognize their broader applicability.

Embodiments herein are related to methods and systems for reducing casting porosity using an in-line pressurization chamber during solidification. Porosity in metal castings significantly decreases material mechanical properties, particularly fatigue performance. As described herein, porosity can be reduced by applying pressure during solidification. For instance, in precision sand casting of an engine block an application of about 3 atmospheres (amt) of absolute pressure may reduce porosity by more than 50%. This is but an example of pressurization for a specific process and specific casting and any suitable pressurization protocol may be utilized. The minimum required pressure for achieving a casting with a sufficiently low level of porosity can be calculated. Such calculation may be done with any commercially available casting process simulation software. Further, the pressure and duration of pressurization may be calculated based on casting geometry, mold conditions, and casting quality requirements. For sand casting process, sand permeability may be used to determine pressure build-up time on the casting and mold interface, i.e., time duration under pressurization.

The disclosed methods and systems are capable of fabricating castings having very thin, very thick, or very complicated geometry as design required. Exemplary castings are high integrity shrinkage free castings produced with minimum riser usage and thus improved material yield.

In exemplary embodiments, the method and system may apply an elevated (absolute) pressure of greater than 1.5, such as greater than 1.75, for example greater than 2, such as greater than 2.25, for example greater than 2.5, such as greater than 2.75, for example greater than 3, such as greater than 3.25 atm, for example greater than 2, such as greater than 2.25 atm. In exemplary embodiments, the method and system may apply an elevated (absolute) pressure of less than 4.5, such as less than 4.25, for example less than 4, such as less than 3.75, for example less than 3.5, such as less than 3.25, for example less than 3, such as less than 2.75 atm, for example less than 2.5, such as less than 2.25 atm.

In exemplary embodiments, the method and system may reduce porosity in castings by at least 20%, such as by at least 30%, for example by at least 40%, such as by at least 50%, for example by at least 60%, as compared to castings fabricated under same casting conditions but at ambient pressure.

As described herein, using the method and system described herein may reduce casting porosity, casting scrap, and warranty cost. Further, castings produced by the method and system described herein may have improved mechanical properties and casting performance. Also, the method and system described herein may allow for a reduced riser size, increased metal yield, and reduced manufacturing cost.

In exemplary embodiments, the methods and systems for reducing casting porosity are utilized in a continuous precision sand casting process. In other exemplary embodiments, the methods and systems for reducing casting porosity are utilized in a continuous semi-permanent mold (SPM) casting process. In still other exemplary embodiments, the methods and systems for reducing casting porosity are utilized in a continuous permanent mold (PM) casting process. For each of the sand casting, SPM casting, and PM casting processes, a unique pressurized chamber may be utilized.

Further, in exemplary embodiments, the pressurized chamber may contain a pressurized gas medium consisting of air. In other embodiments, the pressurized gas medium is mist (air and water). In other embodiments, the pressurized gas medium includes or consists of inert gas. For example, the pressurized gas medium may be at least 50%, such as at least 60%, for example at least 70%, such as at least 80%, for example at least 90%, such as at least 92%, for example at least 94%, such as at least 95%, for example at least 96%, such as at least 97%, for example at least 98% or at least 99% of an inert gas or of a mixture of inert gases. It has been discovered that the use of a high thermal conductivity medium may reduce microstructure fineness.

A suitable inert gas may have high thermal conductivity, i.e., a thermal conductivity greater than the thermal conductivity of air (>0.026 W/mK@ 300K). For example, the inert gas may be helium, having a thermal conductivity of 0.151 W/mK@ 300K. In an exemplary embodiment, the pressurized gas medium has a thermal conductivity of greater than 0.03, such as greater than 0.05, for example greater than 0.1, such as greater than 0.12, such as greater than 0.14 or greater than 0.15 W/mK@ 300K.

It has been recognized that different gas media can be introduced to the pressurized chamber at different times in the process as needed to further improve cooling rate. For example, a high thermal conductivity medium may be introduced at a selected location to increase the heat transfer rate of the casting, for expedited heating and/or expedited cooling.

The pressurized chamber may be stationary or may move in the casting lines.

In exemplary embodiments, methods and systems described herein are used to produce castings from aluminum alloys including, but not limited to, Al—Si based alloys such as A356, A357, 319, 355, and the like; Al—Cu based alloys such as 206 alloy, 242 alloy, and the like; Al—Mg based alloys such as 515, 535, and the like; and Al—Zn based alloys such as 707, 710, and the like.

In exemplary embodiments of methods and systems described herein, the pressure applied during the described pressurization process is no more than 500 Psi. In exemplary embodiments, the pressure applied during the described pressurization process is from 30 Psi (2 atm) to 150 Psi (~10 atm). The pressure may be applied during a portion of, or for the entirety of, the solidification process. For instance, the complete solidification of an engine block may take 600 seconds and the complete solidification of a cylinder may take from 400 to 500 seconds. It is anticipated that the pressurization process should not be stopped until product critical locations such as bulkheads in the engine block and head face in the cylinder head be solidified. Typically, solidification time may take from 150 to 250 seconds for an engine block bulkhead area and from 100 to 200 seconds for a cylinder head deck face area, respectively.

In exemplary embodiments of methods and systems described herein, the casting includes pouring liquid metal at a temperature dependent on the alloy type. Typically, superheat (temperature above alloy liquidus) is from 100 to 200° C. for engine block and cylinder head during mold filling. For an exemplary pressurization medium, the temperature may be from room temperature to 50° C.

Referring now to FIG. 1, an embodiment of an in-line casting system 100 for reducing casting porosity in a continuous casting process is illustrated. As indicated above, the casting process may be a sand casting, SPM casting, or PM casting process. The continuous casting process is performed sequentially along a linear production line 110 in FIG. 1. As shown, the system 100 includes a mold assembly station 120 for assembling a mold. Further, the system 100 includes a fill station or pour station 130 for filling the mold with molten material, such as a molten metal like aluminum, including aluminum alloys.

As shown, the system 100 includes a pressurization station 140 for densifying the molten and/or semi-solid material under an elevated pressure. The pressurization station 140 may be considered to be a pressurized chamber. An exemplary pressurization station 140 may be sealed from the surrounding environment so that elevated pressures may be effectively maintained within the pressurization station 140. Further, the system 100 includes a casting/mold disassembly station 150 for disassembling the mold and the casting formed therein.

In the illustrated embodiment, the pressurized chamber 140 includes three chamber sections: a pre-pressurization chamber section 141, a pressurized chamber section 142, and a pressure-release chamber section 143. Terminal chamber sections 141 and 143 may be selectively sealed from the surrounding environment so that pressures therein may be raised or maintained or lowered as desired. Central chamber section 142 may be selectively sealed from the terminal chamber sections 141 and 143 so that the desired elevated pressure is effectively and constantly maintained within the chamber section 142.

As indicated in FIG. 1, a pressure gauge and valve 161, 162, and 163 is provided in each chamber section 141, 142, and 143, respectively, to monitor and maintain the desired pressure therein. Pressure may be applied from each pressure gauge and valve 161-163 to the casting gate inlet, open risers, and/or the casting mold, depending on the mold materials. For non-metal molds, the pressure may be applied to the gating inlet, open risers, and the casting mold. For metal mold casting, for instance semi-permanent mold casting, the pressure may be directly applied to the gating inlet and open risers.

As shown, the system 100 further includes a control module 170 for controlling operation of the continuous casting process. Further, the system includes a sensor 175 for sensing the readiness of the pressurization station 140. Specifically, the sensor 175 may determine when the pressurization station 140 is ready for an additional mold, or is about to be ready for an additional mold—such as being within 30 seconds, 20 seconds, 10 seconds or 5 seconds of being ready for an additional mold.

As shown in FIG. 1, locations 180, including 181, 182, 183, 184, 185, 186, 187, and 188, are provided for locating mold cells 190 during processing. While each station 120, 130, 140, and 150 may be provided with any desired practical number of locations 180, in the illustrated embodiment, stations 120, 130, and 150 each have one location 180 and station 140 has a plurality of locations. Specifically, pre-pressurization chamber section 141 includes one location 183, pressurized chamber section 142 includes three locations 184-186, and pressure-release chamber section 143 includes one location 187. The number of locations 180 provided in each of the chamber sections 141, 142 and 143 may be optimized to provide for the appropriate duration of time under pressure for the casting being fabricated.

Figure 2:
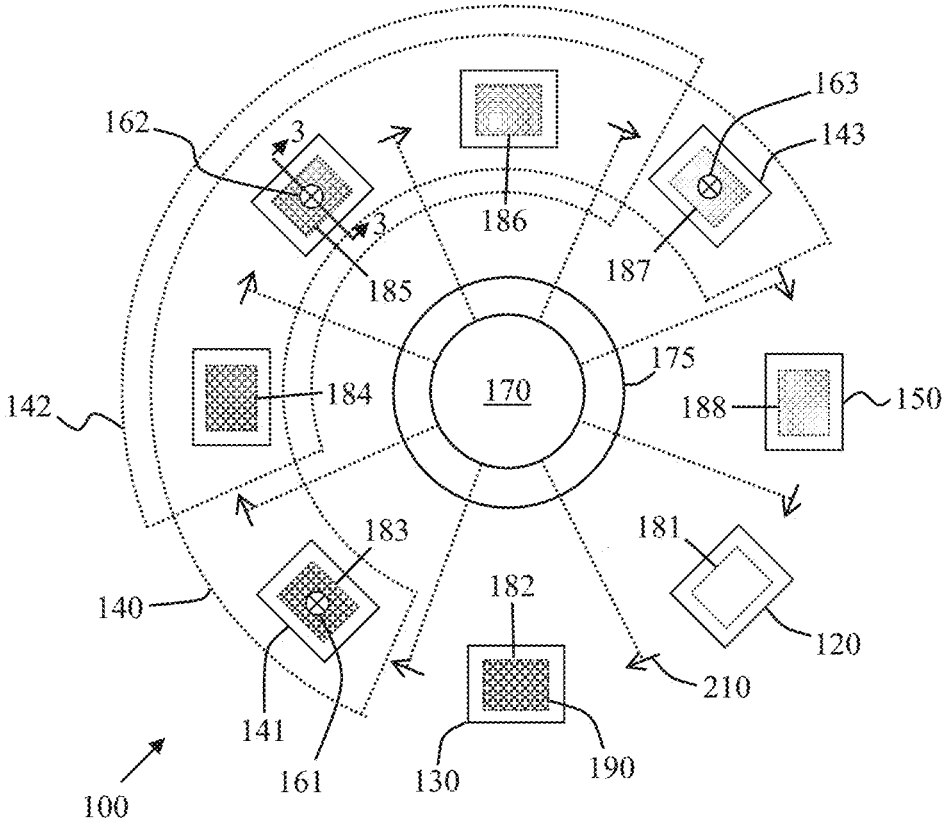
FIG. 2 is a schematic representation of an in-line casting system for reducing casting porosity in a continuous casting process in accordance with another embodiment herein.

Referring now to FIG. 2, in-line casting system 100 is illustrated for use with a carousel or rotary casting line in a continuous casting process. Again, the casting process may be a sand casting, SPM casting, or PM casting process. The continuous casting process is performed sequentially along the rotary production line 210 in FIG. 2. As shown, the system 100 includes a mold assembly station 120 for assembling a mold. Further, the system 100 includes a fill station or pour station 130 for filling the mold with molten material, such as a molten metal like aluminum, including aluminum alloys.

As shown, the system 100 includes a pressurization station 140 for densifying the molten and/or semi-solid material under an elevated pressure. The pressurization station 140 may be considered to be a pressurized chamber. An exemplary pressurization station 140 may be sealed from the surrounding environment so that elevated pressures may be effectively maintained within the pressurization station 140. Further, the system 100 includes a casting/mold disassembly station 150 for disassembling the mold and the casting formed therein.

In the illustrated embodiment, the pressurized chamber 140 includes three chamber sections: a pre-pressurization chamber section 141, a pressurized chamber section 142, and a pressure-release chamber section 143. Terminal chamber sections 141 and 143 may be selectively sealed from the surrounding environment so that pressures therein may be raised or maintained or lowered as desired. Central chamber section 142 may be selectively sealed from the terminal chamber sections 141 and 143 so that the desired elevated pressure is effectively and constantly maintained within the chamber section 142.

As indicated in FIG. 2, a pressure gauge and valve 161, 162, and 163 is provided in each chamber section 141, 142, and 143, respectively, to monitor and maintain the desired pressure therein. Pressure may be applied from each pressure gauge and valve 161, 162, and 163 to the casting gate inlet, open risers, and/or the casting mold, depending on the mold materials. For non-metal molds, the pressure may be applied to the gating inlet, open risers, and the casting mold. For metal mold casting, for instance semi-permanent mold casting, the pressure may be directly applied to the gating inlet and open risers.

As shown, the system 100 further includes a control module 170 for controlling operation of the continuous casting process. Further, the system includes a sensor 175 for sensing the readiness of the pressurization station 140. Specifically, the sensor 175 may determine when the pressurization station 140 is ready for an additional mold, or is about to be ready for an additional mold—such as being within 30 seconds, 20 seconds, 10 seconds or 5 seconds of being ready for an additional mold.

As shown in FIG. 2, locations 80, including 181, 182, 183, 184, 185, 186, 187, and 188, are provided for locating mold cells 190 during processing. While each station 120, 130, 140, and 150 may be provided with any desired practical number of locations 180, in the illustrated embodiment, stations 120, 130, and 150 each have one location 180 and station 140 has a plurality of locations. Specifically, pre-pressurization chamber section 141 includes one location 180, pressurized chamber section 142 includes three locations 180, and pressure-release chamber section 143 includes one station. The number of locations 180 provided in each of the chamber sections 141, 142 and 143 may be optimized to provide for the appropriate duration of time under pressure for the casting being fabricated.

In each of the embodiments of FIGS. 1 and 2, the pressurization station 140 is located immediately after the fill station 130 in the casting line so that the poured casting may be placed under pressurization as soon as the filling process is completed. In certain embodiments, timing of introduction of the poured casting is controlled to avoid casting dimension tolerance and surface quality issues.

It is noted that for SPM or PM casting processes, pressurization may be realized by placing a sealed lid over the top of the open riser or gating system of a respective mold cell 190.

Figure 3:
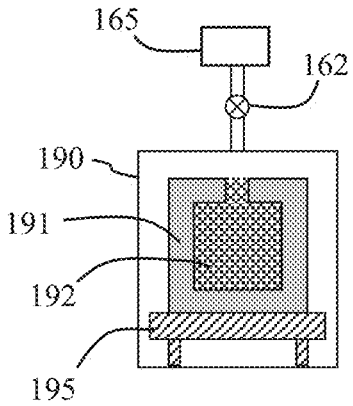
FIG. 3 is a cross-sectional view taken along line 3-3 of an embodiment of the system of FIG. 1 or 2.

Referring now to FIG. 3, a cross-sectional view of FIG. 1 or of FIG. 2, taken along line 3-3 in either figure, is provided to illustrate an exemplary embodiment. As shown, the mold cell 190 contains a mold 191 and casting 192 undergoing solidification therein. The mold 190 is directly supported by the transfer convey 195 of the casting line 110 or 210.

Figure 4:
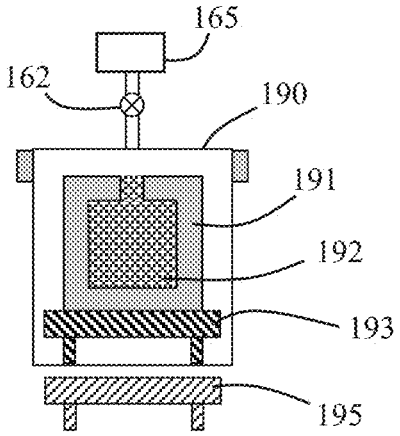
FIG. 4 is a cross-sectional view taken along line 3-3 of another embodiment of the system of FIG. 1 or 2.

Referring now to FIG. 4, a cross-sectional view of FIG. 1 or of FIG. 2, taken along line 3-3 in either figure, is provided to illustrate another embodiment. As shown, the mold cell 190 contains a mold 191, casting 192 undergoing solidification therein, and a support 193 which supports the mold 191. As shown, the mold cell 190 is suspended above the transfer convey 195 of the casting line 110 or 210.

Embodiments herein further provide for performing chill or insert extraction inside the pressurization station 140, and specifically, inside the pressurized chamber section 142.

FIGS. 3-4 illustrate that gauge and valve 162 is in fluid communication with a medium source 165 for providing the pressurization station with a desired medium, such as air, mist, a high thermal conductivity gas, or a mixture thereof. While FIGS. 3-4 only illustrate gauge and valve 162, it is noted that each gauge and valve 161-163 may be in fluid communication with a medium source 165 for providing the pressurization station with a desired medium, either the same medium different mediums for one or more gauge and valves.

Figure 5:
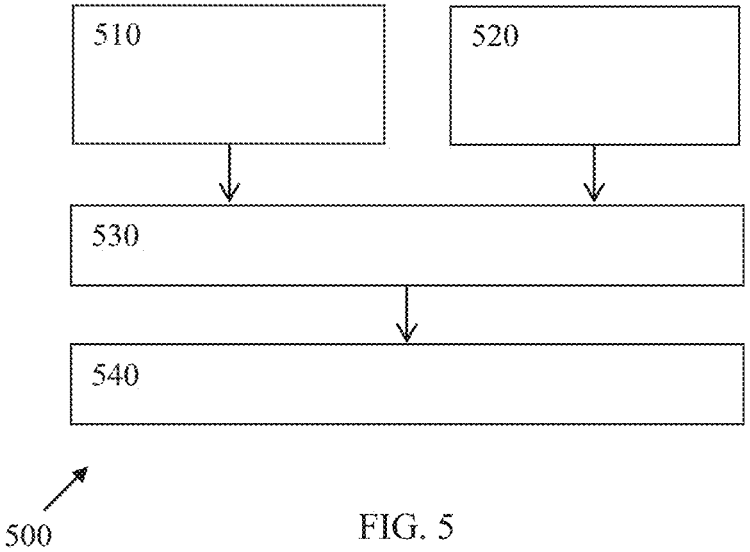
FIG. 5 is a flow chart illustrating a method for continuously producing cast metal components which reduces casting porosity in a continuous casting process in accordance with an embodiment herein.

Referring to FIG. 5, with cross-reference to FIGS. 1 and 2, a method 500 for continuously producing cast metal components which reduces casting porosity in a continuous casting process is illustrated. As shown, the method 500 includes feeding molten material, such as molten metal like an aluminum alloy, into a mold at a fill station 130 at action block 510. Further, the method 500 includes maintaining a pressurized chamber at an elevated pressure at action block 520. After feeding the molten material into the mold, the method includes moving the mold into the pressurized chamber at action block 530. The molten metal solidifies in the mold under the elevated pressure. The method 500 further includes removing the mold from the pressurized chamber at action block 540.

In an exemplary embodiment, the method 500 is performed in a moving casting line, and the pressurized chamber moves in the casting line. In another exemplary embodiment, the pressurized chamber is stationary.

As described above, the method 500 may be performed in a linear casting line or in a carousel casting line. Further, as described above, the method may include maintaining the elevated (absolute) pressure of greater than 1.5, such as greater than 1.75, for example greater than 2, such as greater than 2.25, for example greater than 2.5, such as greater than 2.75, for example greater than 3, such as greater than 3.25 atm, for example greater than 2, such as greater than 2.25 atm. In exemplary embodiments, the method and system may apply an elevated (absolute) pressure of less than 4.5, such as less than 4.25, for example less than 4, such as less than 3.75, for example less than 3.5, such as less than 3.25, for example less than 3, such as less than 2.75 atm, for example less than 2.5, such as less than 2.25 atm.

As described above, the method may include filling and maintaining the pressurized chamber with a pressurized gas medium having a selected composition. For example, the pressurized gas medium may consist of or comprise air, may consist of or comprise mist (air and water), or may consist of or comprise an inert gas, such as helium. Further, the method 500 may include changing the pressurized gas medium during the solidification process of a casting in the pressurized chamber. For example, the method 500 may include introducing a different pressurized gas medium at a selected location with the pressurized chamber.

Figure 6:
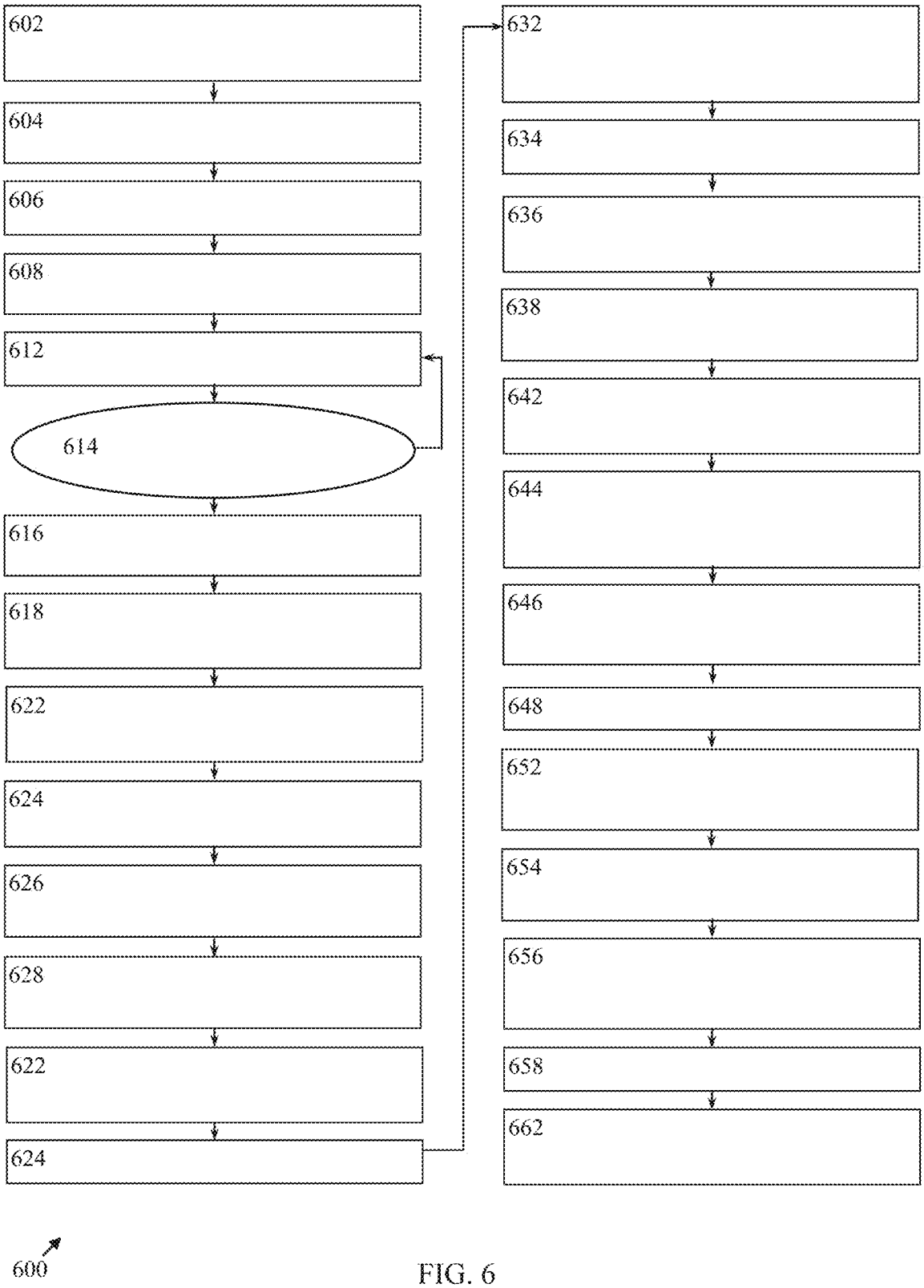
FIG. 6 is a flow chart illustrating a method for continuously producing cast metal components which reduces casting porosity in a continuous casting process in accordance with another embodiment herein.

FIG. 6, with cross-reference to FIGS. 1 and 2, illustrates an embodiment of a method 600 for continuously producing cast metal components which reduces casting porosity in a continuous casting process.

In an exemplary embodiment, method 600 may include designing, building, and testing chamber sections 141, 142 and 143 for the desired casting process and desired casting component, at action block 602. Further, method 600 may include simulating casting of the casting component to tailor and optimize the pressure profile and the maximum pressure to be applied in the pressurized station 140 generally, and in sections 141, 142, and 143 specifically, according to the gas medium or mediums to be used, at action block 604.

The method 600 may also include assembling a mold at the mold assembly station 120 at action block 606. Further, the method 600 may include moving the assembled mold to the fill station at action block 608.

In certain embodiments, the method includes monitoring the pressurization station 140, at action block 612. For example, the method 600 may monitor the readiness of the pressurized station 140 generally, and of chamber sections 141, 142 and 143 specifically, regarding whether the pressure profile and medium is desirable.

At query 614, a control module determines whether the pressurized station 140 is prepared to receive an additional mold and casting, if no, action block 612 is repeated. If the pressurized station 140 is prepared to receive an additional mold and casting then the method continues with feeding molten material, such as molten metal like an aluminum alloy, into the mold at fill station 130 at action block 616. Thus, query 614 provides for controlling the timing of performance of action block 616 based on the readiness of the pressurized station 140 generally, and of chamber sections 141, 142 and 143 specifically.

The method 600 further includes opening a pre-pressurization chamber section 141 of pressurization station 140 at action block 618. The method 600 also includes moving the filled mold, i.e., mold and casting therein, from the fill station 130 to the opened pre-pressurization chamber section 141 of pressurization station 140 at action block 622. The method further includes sealing the pre-pressurization chamber section 141, at action block 624.

In exemplary embodiments, the method 600 includes increasing and maintaining the pressure in the pre-pressurization chamber section 141, such as to the elevated pressure of pressurized chamber section 142 with a desired pressurized gas medium, at action block 626.

Thereafter, the method 600 includes opening fluid communication between the pressurized chamber section 142 and the pre-pressurization chamber section 141, at action block 628. Also, the method 600 includes transferring the mold from the pre-pressurization chamber section 141 to the pressurized chamber section 142, at action block 632. The method 600 further includes sealing the pressurized chamber section 142, at action block 634.

In exemplary embodiments, the method 600 includes maintaining the pressurized chamber section 142 at the elevated pressure with a desired pressurized gas medium, at action block 636. Further, the method 600 includes solidifying the molten metal casting in the mold under the elevated pressure in the pressurized chamber section 142, at action block 638. In exemplary embodiments, a significant portion of the casting is solidified in the pressurized chamber section 142, such as more than 80%, for example more than 90%, such as about 95% of the casting.

In exemplary embodiments, the method 600 includes maintaining a pressure-release chamber section 143 at the elevated pressure with a desired pressurized gas medium, at action block 642.

The method 600 includes opening fluid communication between the pressurized chamber section 142 and the pressure-release chamber section 143, at action block 644. Further, the method 600 includes transferring the mold from the pressurized chamber section 142 to the pressure-release chamber section 143, at action block 646. While the casting may be fully solidified in the pressurized chamber section 142, in exemplary embodiments, the casting in the mold is near fully solidified when transferred to the pressure-release chamber section 143, such as more than 80%, for example, more than 90%, such as about 95% solidified. The method 600 also includes sealing the pressurized chamber section 142, at action block 648.

In exemplary embodiments, the method 600 includes maintaining the pressure-release chamber section 143 at the elevated pressure with a desired pressurized gas medium, at action block 652.

The method 600 may include completing solidification of the casting in the pressure-release chamber section 143 at the elevated pressure, at action block 654. Further, the method 600 includes opening the pressure-release chamber section 143 and removing the fully solidified casting and mold from the pressure-release chamber section 143, at action block 656. Also, the method 600 includes cooling the casting and mold, at action block 658. The method 600 further includes disassembling the mold and casting formed therein at the casting/mold disassembly station 150, at action block 662.

For application of pressure in each of the chamber sections, pressure may be applied to the casting gate inlet, open risers, and/or the casting mold, depending on the mold materials. For non-metal molds, the pressure is applied to the gating inlet, open risers, and the casting mold. For metal mold casting, for instance semi-permanent mold casting, the pressure may be directly applied to the gating inlet and open risers.

Method 600 is contemplated to continuously produce castings. Therefore, as a first mold, i.e., a downstream mold, moves from a current station to a next station, a second mold, i.e., an upstream mold, moves in replacement at the current station. Within the pressurization station, a second mold or additional molds may be moved into the pressurized chamber section and accompany downstream molds until the downstream molds are removed from the pressurized chamber section.

Use of the pre-pressurization chamber section 141 and pressure-release chamber section 143 allow for opening of the pressurized chamber section 142 to introduce upstream and remove downstream molds without loss of pressure in the pressurized chamber section 142.

In exemplary embodiments, the pressure profile of the chamber sections are tailored and optimized for the material and mold being cast and casting process using integrated computational materials engineering, at action blocks 602 and 604.

Each of action blocks 626, 636, 642, and 652 may include introducing different gas media to provide a desired heat transfer rate, and/or performing chill or insert extraction.

By monitoring the readiness of the pressurized station 140, the method 600 provides for automatically and digitally controlling processing of subsequent castings during a continuous process.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method for continuously producing cast metal components, comprising:

feeding molten metal into a first mold at a fill station;

providing a pressurized chamber including an upstream terminal chamber section, a central chamber section, and a downstream terminal section;

maintaining the central chamber section of the pressurized chamber at an elevated pressure;

moving the first mold from the fill station into the upstream terminal chamber section of the pressurized chamber;

sealing the upstream terminal chamber section of the pressurized chamber;

pressurizing the upstream terminal chamber section of the pressurized chamber;

moving the first mold from the upstream terminal chamber section to the central chamber section;

moving the first mold from the central chamber section to the downstream terminal chamber section, wherein the molten metal solidifies in the first mold under the elevated pressure; and removing the first mold from the downstream terminal chamber section of the pressurized chamber.

2. The method of claim 1 wherein the method is performed in a casting line, and wherein the pressurized chamber moves in the casting line.

3. The method of claim 1 wherein the pressurized chamber is stationary.

4. The method of claim 1 wherein the method is performed in a carousel casting line.

5. The method of claim 1 wherein the method is performed in a casting line including, sequentially, a mold assembly station, the fill station, upstream terminal chamber section, the central chamber section, the downstream terminal chamber section, and a casting/mold disassembly station.

6. The method of claim 5 further comprising:

assembling the first mold at the mold assembly station;

moving the first mold to the fill station where the molten metal is fed into the first mold and assembling a second mold at the mold assembly station;

moving the first mold to the upstream terminal chamber section and moving the second mold to the fill station where the molten metal is fed into the second mold;

sealing the upstream terminal chamber section and increasing pressure in the upstream terminal chamber section to the elevated pressure of the central chamber section;

opening fluid communication between the central chamber section and the upstream terminal chamber section and transferring the first mold from the upstream terminal chamber section to the central chamber section;

sealing the central chamber section;

moving the second mold to the upstream terminal chamber section;

sealing the upstream terminal chamber section and increasing pressure in the upstream terminal chamber section to the elevated pressure of the central chamber section;

opening fluid communication between the central chamber section and the upstream terminal chamber section and transferring the second mold from the upstream terminal chamber section to the central chamber section;

opening fluid communication between the central chamber section and the downstream terminal chamber section and transferring the first mold from the upstream terminal chamber section to the downstream terminal chamber section;

transferring the first mold from the downstream terminal chamber section to the casting/mold disassembly station;

sealing the downstream terminal chamber section and increasing pressure in the downstream terminal chamber section to the elevated pressure of the central chamber section;

opening fluid communication between the central chamber section and the downstream terminal chamber section and transferring the second mold from the central chamber section to the downstream terminal chamber section;

disassembling the first mold and first casting formed therein at the casting/mold disassembly station;

transferring the second mold from the downstream terminal chamber section to the casting/mold disassembly station; and disassembling the second mold and second casting formed therein at the casting/mold disassembly station.

7. An in-line casting system comprising:

a mold assembly station for assembling a mold;

a fill station for filling the mold with molten metal;

a pressurization station for densifying the molten and/or semi-solid metal under an elevated pressure, wherein the pressurization station comprises a series of chambers including a first chamber and a second chamber; and a casting/mold disassembly station for disassembling the mold and a casting formed therein.

8. The in-line casting system of claim 7, wherein the series further includes a third chamber, wherein the first chamber is a pre-pressurization chamber section, wherein the second chamber is a pressurized chamber, and wherein the third chamber is a pressure-release chamber.

9. The in-line casting system of claim 8, wherein the pressurization station is configured to simultaneously hold a first mold, a second mold, and a third mold.

10. The in-line casting system of claim 7, wherein the series further includes a third chamber, wherein the first chamber is a pre-pressurization chamber, wherein the second chamber is a constant elevated pressure chamber, and wherein the third chamber is a pressure-release chamber.

11. The in-line casting system of claim 7, further comprising a pressure gauge and valve to monitor pressure in the pressurization station and to selectively add a medium to the pressurization station.

12. The in-line casting system of claim 7, wherein the mold assembly station, fill station, pressurization station, and casting/mold disassembly station are arranged in a linear casting line.

13. The in-line casting system of claim 7, wherein the mold assembly station, fill station, pressurization station, and casting/mold disassembly station are arranged in a carrousel casting line.

14. The in-line casting system of claim 7, further comprising a control module and a sensor, wherein the sensor is arranged to monitor readiness of the pressurization station, and wherein the control module directs filling the mold at the fill station when the pressurization station is ready.

15. The in-line casting system of claim 7, further comprising a control module and a sensor, wherein the control module and the sensor are configured to maintain a constant elevated pressure in the second chamber.

16. The in-line casting system of claim 7, further comprising a transfer convey configured to move the mold from the first chamber to the second chamber.

17. An in-line continuous casting system comprising:

a mold assembly station for assembling a mold;

a fill station for filling the mold with molten metal;

a pressurization chamber for densifying the molten and/or semi-solid metal under an elevated pressure higher than a pressure in a surrounding environment, wherein the pressurization chamber includes an upstream terminal chamber section, a central chamber section, and a downstream terminal chamber section, wherein the terminal chamber sections are configured to be selectively sealed from the surrounding environment, and wherein the central chamber section is configured to be selectively sealed from the terminal chamber sections;

a high thermal conductivity medium source for providing the pressurization chamber with a desired medium; and a casting/mold disassembly station for disassembling the mold and a casting formed therein.

18. The in-line continuous casting system of claim 17, further comprising a control module and a sensor, wherein the control module and the sensor are configured to maintain a constant elevated pressure in the central chamber section.

19. The in-line continuous casting system of claim 17, further comprising a transfer convey configured to move the mold from the fill station to the upstream terminal chamber section, from the upstream terminal chamber section to the central chamber section, from the central chamber section to the downstream chamber section, and from the downstream chamber section to the casting/mold disassembly station.

20. The in-line continuous casting system of claim 17, wherein the upstream terminal chamber section, a central chamber section, and a downstream terminal chamber section are configured to simultaneously hold a first mold, a second mold, and a third mold, respectively.

* * * * *